US006024432A

United States Patent [19]

Aruga et al.

[11] Patent Number: 6,024,432

[45] **Date of Patent: *Feb. 15, 2000**

[54] INK-JET RECORDING APPARATUS

[75] Inventors: Yoshiharu Aruga; Kazunaga Suzuki; Koichi Toba, all of Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/955,109

[22] Filed: Oct. 21, 1997

[30] Foreign Application Priority Data

Oct. 21, 1996 [JP] Japan ..... 8-297839

[51] Int. Cl.[7] ..... B41J 2/165

[52] U.S. Cl. ..... 347/23; 400/702.1

[58] Field of Search ..... 347/23, 14; 400/701, 400/702, 702.1

[56] References Cited

U.S. PATENT DOCUMENTS 5,903,288 5/1999 Yamaguchi ..... 347/23

FOREIGN PATENT DOCUMENTS 0 442 438 8/1991 European Pat. Off. ..... B41J 2/165
0 499 432 8/1992 European Pat. Off. ..... B41J 2/165
0 525 988 2/1993 European Pat. Off. ..... 347/23
0 551 752 7/1993 European Pat. Off. ..... B41J 2/165
0 785 074 7/1997 European Pat. Off. ..... B41J 2/165

OTHER PUBLICATIONS

Patent Abstracts of Japan vol. 016, No. 132 (M–1229) Apr. 3, 1992 & JP 03 293153 A (Canon Inc) Dec. 24, 1991 *Abstract.

Patent Abstracts of Japan vol. 017 No. 126 (M–1381), Mar. 17, 1993 & Jp 04 308761 A(ALPS Electric Co Ltd) Oct. 30, 1992, *Abstract.

*Primary Examiner*—N. Le
*Assistant Examiner*—Judy Nguyen
*Attorney, Agent, or Firm*—Sughrue, Mion, Zinn, Macpeak & Seas, PLLC

[57] ABSTRACT

A sealing timer (25) for measuring the time in which the recording head (7) is sealed by the capping device (10); an opening timer (26) for measuring the time in which the recording head (7) is opened to the atmosphere; and a cleaning control means having a first cleaning mode in which a predetermined quantity of ink is sucked, a second cleaning mode in which a larger quantity of ink than the quantity of ink sucked in the first cleaning mode is sucked, and a third cleaning mode in which a quantity of ink substantially equal to the quantity of ink sucked in the second cleaning mode is divided into two portions and the two portions may be sucked at two separate times. Wiping or rubbing is performed by the cleaning member (18) during a period of time when the two portions are sucked, the cleaning control device (20) slects at least one of the first, second and third cleaning modes on the basis of data of the timers (25) and (26) in accordance with a cleaning instruction, the three modes being used automatically selectively in accordance with the situation of the recording head (7) to thereby perform cleaning.

5 Claims, 4 Drawing Sheets

INK-JET RECORDING APPARATUS

BACKGROUND OF THE INVENTION

1. Field of the Invention

This invention relates to an ink-jet recording apparatus in which an ink drop is discharged from a nozzle opening to print a pattern on a recording medium.

2. Background

Since an ink-jet recording apparatus uses a recording head in which ink in a pressure generating chamber is pressurized by a piezoelectric vibrator or a heating element to thereby discharge an ink drop from a nozzle opening, countermeasures are required to prevent the lowering of printing quality caused by ink drying and dust deposition in the vicinity of the nozzle opening.

As one of the countermeasures, a flushing operation is carried out in a manner such that a recording head is moved to an ink receiving member such as a capping means, or the like, provided in a standby position of a non-printing region to discharge an ink drop from the nozzle opening regardless of printing data whenever a predetermined time, for example, of 20 seconds is passed in a state where the recording head is opened from the capping means for printing or standby.

According to such flushing operation, although nozzle opening choking generated in the recording head opened from the capping means in a running state can be eliminated by such flushing, choking generated in the case where the recording head is left for a long time in a power-off state or left for a long time without capping because of an accident, or the like, cannot be eliminated.

In such a case, the recording head is sealed by a capping means and negative pressure is applied to the capping means from a suction pump so that a first cleaning mode is executed for forcedly sucking ink by a predetermined quantity, for example, about 0.6 cc from the nozzle opening, and, if necessary, a second cleaning mode for sucking a larger quantity of ink than the quantity of ink sucked in the first cleaning mode and a third cleaning mode for sucking a slightly larger quantity of ink than the quantity of ink sucked in the second cleaning mode and rubbing the nozzle plate by means of an elastic plate of rubber, or the like, after the completion of ink suction are executed in order in accordance with the number of times of cleaning instruction.

In this manner, choking can be eliminated in most cases, but there arises a problem that ink is used wastefully because the first cleaning mode is always applied to choking even in the case where the choking is severe so that it cannot be eliminated by suction of about 0.6 cc of ink.

Upon such circumstances, an object of the present invention is to provide an ink-jet recording apparatus having a cleaning means by which choking is eliminated securely while the quantity of consumed ink is suppressed.

SUMMARY OF THE INVENTION

In order to solve the aforementioned problem, the present invention provides an ink-jet recording apparatus comprising: a recording head discharging an ink drop from a nozzle opening of a nozzle plate, the recording head mounted on a carriage reciprocating in a direction of the width of a recording medium; an ink cartridge supplying ink to the recording head; a capping means sealable to the recording head in order to maintain the ink drop discharging ability of the recording head; a cleaning member brought into contact with the nozzle plate to perform wiping or rubbing; a pump supplying a negative pressure to the capping means; a sealing timer measuring the time in which the recording head is sealed by the capping means; an opening timer measuring the time in which the recording head is opened to the atmosphere; and a cleaning control means having a first cleaning mode in which a predetermined quantity of ink is sucked, a second cleaning mode in which a larger quantity of ink than the quantity of ink sucked in the first cleaning mode is sucked, and a third cleaning mode in which a quantity of ink not smaller than the quantity of ink sucked in the second cleaning mode is sucked and the nozzle plate is wiped or rubbed by the cleaning member, the cleaning control means selecting at least one of the first, second and third cleaning modes on the basis of data of the sealing timer or opening timer in accordance with a cleaning instruction to clean the recording head.

Further, in the above ink-jet recording apparatus, the third cleaning mode of the cleaning control means, in which the quantity of ink substantially equal to the quantity of ink sucked in the second cleaning mode may be divided into two portions and the two portions may be sucked at two separate times. Accordingly, the nozzle plate is wiped or rubbed by the cleaning member during a period of time when the two portions are sucked.

According to the invention, the three modes are used automatically selectively in accordance with the situation of the recording head so that the ink discharging ability of the recording head is recovered securely in a smaller number of times and in a smaller quantity of ink.

DETAILED DESCRIPTION OF THE PREFERRED EMBODIMENT

The present invention will be described below in detail on the basis of illustrated embodiments.

Figure 1:
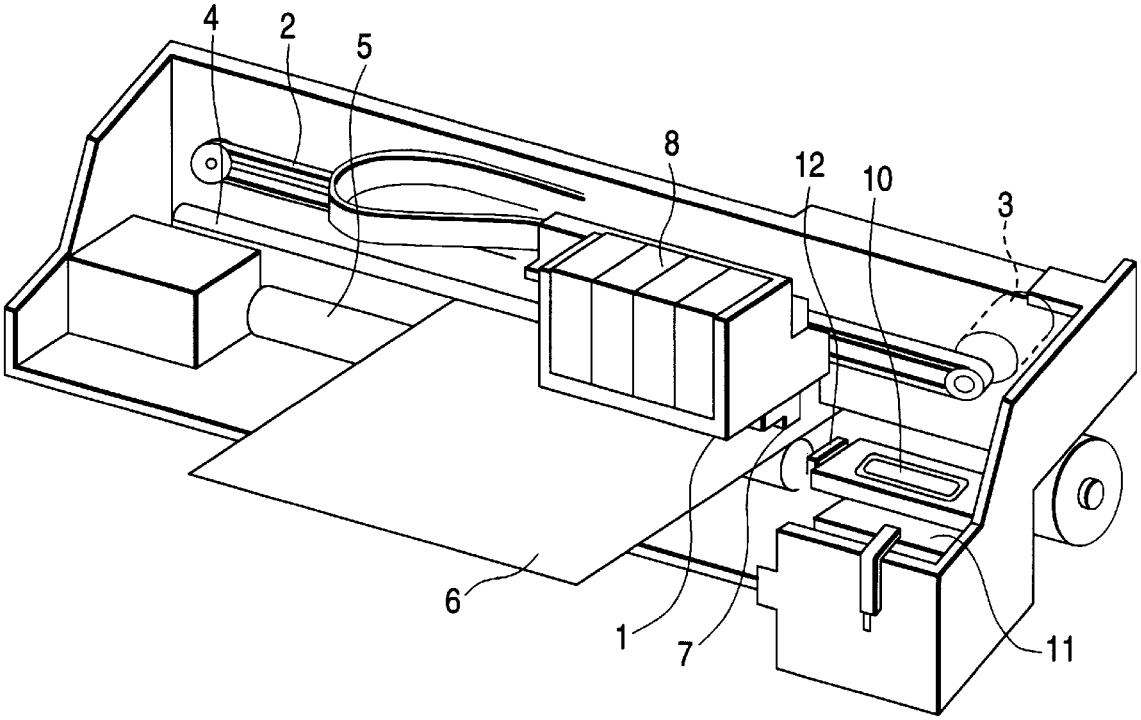
FIG. 1 shows an embodiment of an ink-jet recording apparatus according to the present invention.

FIG. 1 shows an embodiment of the present invention. In the drawing, the reference numeral 1 designates a carriage which is connected to a motor 3 by a timing belt 2 and which is guided by a guide member 4 so as to move in parallel with a platen 5. A recording head 7 is provided on a surface of the carriage 1 facing a recording sheet 6 so that the recording head 7 is supplied with ink from an ink cartridge 8 and discharges an ink drop from a nozzle opening when a pressure generating chamber is pressed by a piezoelectric vibrator or a heating element.

The reference numeral 10 designates a capping device which is connected to a suction pump 11 through a tube. The capping device 10 has such a size that the capping device can seal the nozzle opening surface of the recording head 7 by one space. The capping device 10 is configured po that the capping device 10 can seal the nozzle opening surface at the time of non-printing while the capping device 10 is supplied with a negative pressure from the suction pump 11 so as to be able to discharge ink from the recording head 7 forcedly at the time of a discharge ability recovery operation.

A cleaning device 12 having an elastic plate of rubber, or the like, is provided in the vicinity of the capping device 10 so that the cleaning device 12 is interlocked with the movement of the carriage 1 to be pushed up or moved horizontally in a paper feeding direction to thereby abut on a nozzle plate of the recording head 7 when the recording head 7 moves to a cleaning position.

Figure 2:
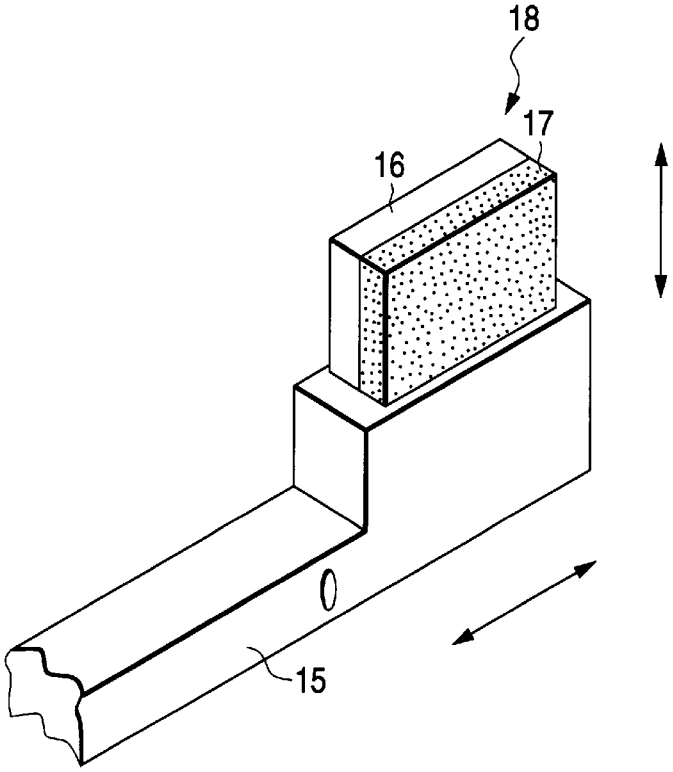
FIG. 2 shows an embodiment of the cleaning means in the same apparatus.

FIG. 2 shows an embodiment of the above-mentioned cleaning device. The cleaning device includes a lever 15, and a cleaning member 18 fixed to the lever 15 at its end portion. The lever 15 is connected to a carriage drive mechanism, or the like, so as to be moved up/down or moved horizontally in the paper feeding direction by the movement of the carriage 1. The cleaning member 18 has an elastic plate 16 of rubber, or the like, which moves back and forth along the locus of the movement of the recording head 7, and a plate 17 which is formed of an ink absorbing material such as felt, or the like, and stuck to the elastic plate 16.

Figure 3:
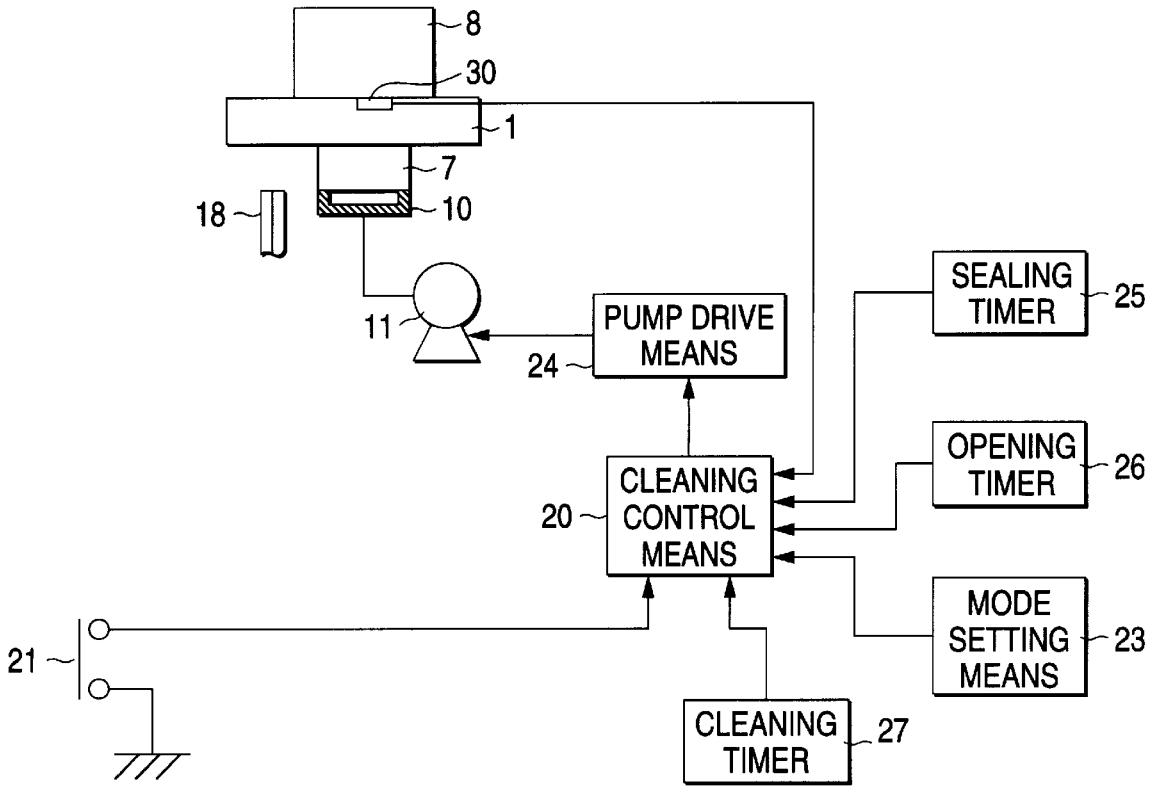
FIG. 3 is a block diagram showing an embodiment of a cleaning controller in the present invention.

FIG. 3 shows an embodiment of a cleaning controller. In the drawing, the reference numeral 20 designates a cleaning control means or device which is designed so that when a cleaning switch 21 provided on a panel surface is operated, the cleaning control means 20 selects data in a mode setting means 23 (which will be described later) on the basis of the sealing time during which the recording head 7 is sealed by the capping device 10, the opening time during which the recording head 7 is opened from the capping device 10, the presence/absence of mounting of the cartridge 8, and so on, to thereby select one of a plurality of cleaning modes stored to operate a pump drive means 24 so that the quantity of suction of the pump agrees with the value set in the selected mode. Further, when rubbing is required, the cleaning control means 20 makes a carriage control means (not shown) bring the cleaning member 18 into contact with the nozzle plate of the recording head 7 to thereby move the recording head 7.

The reference numeral 23 designates a mode setting means as described above. The mode setting means 23 stores data of three modes including a first cleaning mode CL1, a second cleaning mode CL2 and a third cleaning mode CL3, as shown in Table 1.

TABLE 1

| Mode | CL1 | CL2 | CL3 |
|---|---|---|---|
| Quantity of Suction Ink (cc) | 0.6 | 1.2 | 0.1 + 1.2 |
| Number of times in rubbing | 0 | 0 | 3 |

The mode setting means 23 further stores data of a timer cleaning mode, an out-of-home-position cleaning mode and an ink cartridge exchange cleaning mode which are to be executed automatically, without waiting for the operation of the cleaning switch 21, in the case where data is given from timers, in the case where standby out of home position for a predetermined time is detected, and in the case where exchange of the ink cartridge 8 is detected.

In the first cleaning mode CL1, the quantity of ink sucked and discharged from the recording head 7 is set to be the smallest value, for example, 0.6 cc. In the second cleaning mode CL2, the quantity of sucked ink is set to be about twice as much as the set value in the first cleaning mode, for example, to be about 1.2 cc. In the third cleaning mode CL3, the quantity of sucked ink is set to be the largest value, for example, about 1.3 cc. The third cleaning mode CL3 is designed so that the operation of sucking 1.3 cc of ink is separated into two portions. That is, in the third cleaning mode CL3, after 0.1 cc of ink is sucked, a rubbing operation is carried out by the cleaning member 18 and then 1.2 cc of ink as the residual ink (1.3−0.1=1.2) is sucked.

The reference numeral 25 designates a sealing timer for measuring the time during which the recording head 7 is sealed by the capping device 10. The reference numeral 26 designates an opening timer for measuring the time during which the recording head 7 is opened from the capping device 10. Incidentally, whether the recording head 7 is sealed by the capping device 10 or not can be detected by the detection of the position of the carriage 1 on the basis of the signal of the carriage control means, or the like.

The operation of the thus configured apparatus will be described below with reference to FIGS. 4 and 5 which are flow charts showing the operation.

Figure 4:
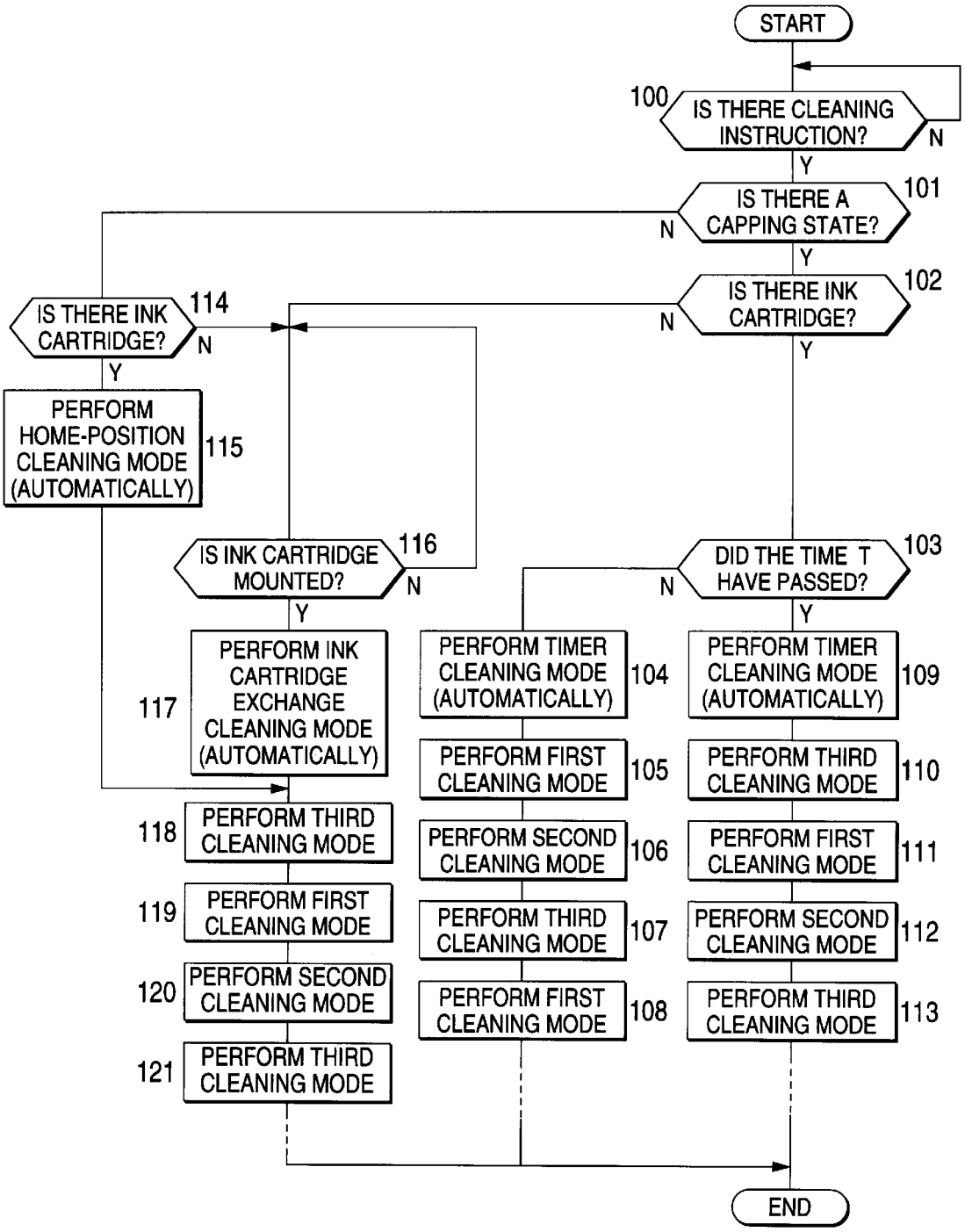
FIG. 4 is a flow chart showing the operation of the apparatus in first and second cleaning modes, an ink cartridge exchange cleaning mode, a out-of-home-position cleaning mode and a timer cleaning mode.

When the cleaning button 21 is operated or a cleaning instruction is issued from the cleaning timer 27 managing the cleaning sequence (step 100 in FIG. 4), whether the recording head 7 is capped or not is judged on the basis of the position of the carriage 1 (step 101 in FIG. 4).

If the recording head 7 is capped, the cleaning control means 20 detects whether the cartridge 8 is mounted on the recording head 7 or not, on the basis of the signal from the cartridge detecting means 30 (step 102 in FIG. 4).

If the ink cartridge 8 is mounted, the sealing time during which the recording head 7 has been capped is detected by the sealing timer 25. If the sealing time is shorter than T1, for example, 2 weeks (step 103 in FIG. 4), the cleaning control means 20 reads the data of timer cleaning TCL from the mode setting means 23 to perform cleaning automatically (step 104 in FIG. 4) and then reads the data of the first cleaning mode CL1 from the mode setting means 23 (step 105 in FIG. 4).

In the case where the cleaning button 21 is operated, the cleaning control means 20 operates the suction pump 11 for a predetermined time on the basis of the data of the first cleaning mode CL1 to discharge a predetermined quantity of ink, for example, 0.6 cc of ink in this embodiment, from the recording head 7.

If the cleaning button 21 is further operated by a plurality of times, the cleaning control means 20 repeats the procedure of executing the second cleaning mode CL2 (step 106 in FIG. 4) successively and the third cleaning mode CL3 (step 107 in FIG. 4) successively in order correspondingly to the number of the times of operation of the cleaning button 21 and then returning the first cleaning mode CL1 again (step 108 in FIG. 4).

When the sealing time by means of the capping device 10 is longer than the time T1, the cleaning control means 20 reads the data of timer cleaning TCL from the mode setting means 23 to perform cleaning automatically (step 109 in FIG. 4), and then selects the cleaning mode CL3 (step 110 in FIG. 4). If the cleaning button 21 is operated, the cleaning control means 20 first sucks a small quantity of ink, for example, about 0.1 cc of ink in this embodiment, from the recording head 7 on the basis of the data of the third cleaning CL3 (step 111 in FIG. 4).

By the first suction of such a small quantity of a ink, a part of dye or a pigment precipitated in the vicinity of the nozzle opening of the nozzle plate due to long-time exposure to the atmosphere is made to flow or softened by an ink solvent even if it is not made to flow.

Figure 5:
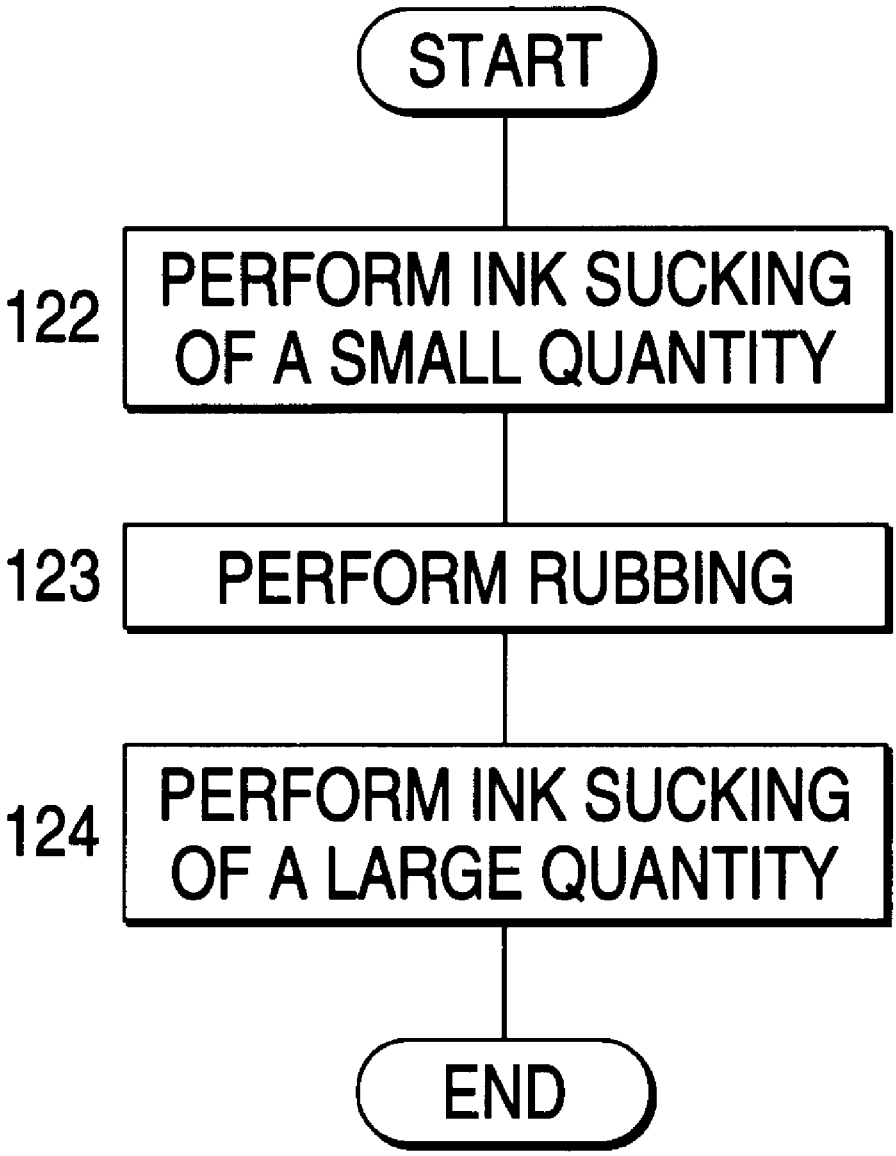
FIG. 5 is a flow chart showing the operation of the apparatus in a third cleaning mode.

In the stage in which the first suction of ink from the recording head 7 is completed, the cleaning control means 20 opens the recording head 7 from the capping device 10 and moves the carriage 1 to the rubbing position so that the recording head 7 is rubbed with the cleaning member 18 (step 123 in FIG. 5).

By the rubbing operation, the precipitated dye or pigment softened by the suction of the small quantity of ink just before is wiped out by rubbing by means of the cleaning member 18. At this point of time, the nozzle plate is wet with ink and the precipitated matter is softened. Accordingly, the cleaning member 18 moves smoothly on the nozzle plate surface, that is, there is no fear that the nozzle plate is injured.

In the stage in which the rubbing operation on the recording head 7 by means of the cleaning member 18 is completed, the cleaning control means 20 moves the carriage 1 to the capping position again and sucks a large quantity of ink, for example, about 1.2 cc of ink in third embodiment, from the recording head 7 (step 124 in FIG. 5).

By the second suction of the large quantity of ink, the softened dye or pigment penetrated into the nozzle opening by the above-mentioned rubbing operation can be ejected.

When the cleaning button 21 is further operated, cleaning operations for different modes are executed in the order of the first cleaning mode CL1 (step 111 in FIG. 4), the second cleaning mode CL2 (step 112 in FIG. 4) and the third cleaning mode CL3 (step 113 in FIG. 4) in accordance with the number of times of the operation of the cleaning button 21.

As described above, when the recording head 7 is left as it is in a state where it is opened from the capping device 10 for a long time, the first cleaning mode CL1 to be executed in the normal condition is skipped and the third cleaning mode CL3 is first executed so that the dye or pigment precipitated in the vicinity of the nozzle opening is washed away with the large quantity of ink or even in the case where the dye or pigment can not be washed away, the dye or pigment is softened with ink securely and then wiped out by the cleaning member 18. Accordingly, the precipitated matter which cannot be wiped out in the first cleaning mode CL1 in which the quantity of sucked ink is small, can be wiped out by cleaning at a time so that the number of times of cleaning is reduced and the wasteful use of ink necessary for cleaning is prevented.

Incidentally, in the case where the ink cartridge 8 is not mounted although the recording head 7 is sealed by the capping device 10 (step 102 in FIG. 4), the situation of the operation jumps to the step 116 which will be described later.

On the contrary, in the case where the recording head 7 is left as it is in a state where it is opened to the atmosphere without being sealed by the capping device 10 (step 101 in FIG. 4), the cleaning control means 20 detects the presence or absence of the ink cartridge 8 on the basis of the signal from the cartridge detecting means or device 30 (step 114 in FIG. 4). If the ink cartridge 8 is mounted on the recording head 7, the cleaning control means 20 executes out-of-home-position cleaning HPCL automatically through the mode setting means 23 regardless of the time during which the recording head 7 has been sealed by the capping device 10 (step 115 in FIG. 4) and then selects the data of the third cleaning mode CL3 (step 118 in FIG. 4).

If the cleaning button 21 is operated, the cleaning control means 20 first sucks a small quantity of ink, for example, about 0.1 cc of ink in this embodiment, from the recording head 7 on the basis of the data of the third cleaning mode CL3 (step 122 in FIG. 5).

By the first suction of such a small quantity of ink, a part of the dye or pigment precipitated in the vicinity of the nozzle opening of the nozzle plate due to long-time exposure to the atmosphere is washed away with ink or softened by an ink solvent even if it is not washed away.

In the stage in which the first suction of the small quantity of ink from the recording head 7 is completed, the cleaning control means 20 opens the recording head 7 from the capping device 10 and moves the carriage 1 to the rubbing position so that the recording head 7 is rubbed with the cleaning member 18 (step 123 in FIG. 5). By the rubbing operation, the precipitated dye or pigment softened by the suction of the small quantity of ink just before is wiped out by rubbing by means of the cleaning member 18.

In the stage in which the rubbing operation on the recording head 7 by means of the cleaning member 18 is completed, the cleaning control means 20 moves the carriage 1 to the capping position again and sucks a large quantity of ink, for example, about 1.2 cc of ink in this embodiment, from the recording head 7 (step 124 in FIG. 5). By the second suction of the large quantity of ink, the softened dye or pigment penetrated into the nozzle opening by the above-mentioned rubbing operation can be ejected.

When the cleaning button 21 is further operated, the procedure of executing the first cleaning mode CL1 (step 118 in FIG. 4) and the second cleaning mode CL2 (step 120 in FIG. 4) in order and returning the third cleaning mode CL3 again (step 121 in FIG. 4) is repeated in accordance with the number of times of the operation of the cleaning button 21.

On the contrary, when the ink cartridge 8 is not mounted on the recording head 7, an alarm is issued by means of an indicator (not shown), or the like, to urge the user to mount the cartridge (step 116 in FIG. 4).

When the mounting of the cartridge 8 is detected on the basis of the signal from the cartridge detecting means 30, the cleaning control means 20 executes an ink cartridge exchange cleaning operation through the mode setting means 23 (step 117 in FIG. 4) and then selects the third cleaning mode CL3.

If the cleaning button 21 is operated, the cleaning control means 20 first sucks a small quantity of ink, for example, about 0.1 cc of ink in this embodiment, from the recording head 7 on the basis of the data of the third cleaning mode CL3 (step 122 in FIG. 5). That is, the largest quantity of ink, for example, 1.3 cc of ink in this embodiment, is sucked (step 105 in FIG. 4).

By the suction of such a small quantity of ink, a part of the dye or pigment precipitated in the vicinity of the nozzle opening of the nozzle plate due to long-time exposure to the atmosphere is washed away with ink or softened by an ink solvent even in the case where it is not washed away.

In the stage in which the first suction of the small quantity of ink from the recording head 7 is completed, the cleaning control means 20 opens the recording head 7 from the capping device 10 and moves the carriage 1 to the rubbing position so that the recording head 7 is rubbed with the cleaning member 18 (step 103 in FIG. 5). By the rubbing operation, the precipitated dye or pigment softened by the suction of ink just before is wiped out by rubbing by means of the cleaning member 18.

In the stage in which the rubbing operation on the recording head 7 by means of the cleaning member 18 is completed, the cleaning control means 20 moves the carriage 1 to the capping position again and sucks a large quantity of ink, for example, about 1.2 cc of ink in this embodiment, from the recording head 7 again (step 124 in FIG. 5).

By the second suction of the large quantity of ink, the softened dye or pigment penetrated into the nozzle opening by the above-mentioned rubbing operation can be ejected. If necessary, when the cleaning button 21 is further operated, the procedure of the first cleaning mode CL1 (step 119 in FIG. 4), the second cleaning mode CL2 (step 120 in FIG. 4) and the third cleaning mode CL3 (step 121 in FIG. 4) in order is executed in accordance with the number of times of the operation of the cleaning button 21.

As described above, according to the present invention, since the three modes can be used automatically selectively in accordance with the situation of the recording head, the ink discharging ability of the recording head can be recovered securely by a smaller number of times of operation and by a smaller quantity of ink.

What is claimed is:

1. An ink-jet recording apparatus, comprising:

a recording head discharging an ink drop from a nozzle opening of a nozzle plate, the recording head mounted on a carriage reciprocating in a direction of the width of a recording medium;

an ink cartridge supplying ink to said recording head;

a capping device sealable to said recording head in order to maintain the ink drop discharging ability of said recording head;

a cleaning member brought into contact with said nozzle plate to perform wiping or rubbing;

a pump supplying a negative pressure to said capping device;

a sealing timer measuring the time, in which said recording head is sealed by said capping device;

an opening timer measuring the time, in which said recording head is opened to the atmosphere; and a cleaning control device having:

a first cleaning mode in which a predetermined quantity of ink is sucked, a second cleaning mode in which a larger quantity of ink than the quantity of ink sucked in said first cleaning mode is sucked, and a third cleaning mode in which a quantity of ink substantially equal to or larger than the quantity of ink sucked in said second cleaning mode is sucked and said nozzle plate is wiped or rubbed by said cleaning member, wherein said cleaning control device selects at least one of said first, second and third cleaning modes on the basis of data of one of said sealing timer and opening timer in accordance with a cleaning instruction to clean said recording head.

2. The ink-jet recording apparatus of claim 1, further comprising an ink cartridge detecting device, wherein said cleaning control device selects said first, second and third cleaning modes on the basis of a signal from said ink cartridge detecting device and data of one of said sealing timer and opening timer.

3. The ink-jet recording apparatus of claim 1, wherein said cleaning control device selects said first cleaning mode when said recording head is sealed by said capping device for a time shorter than a predetermined time, and wherein said cleaning control device skips said first cleaning mode, and said cleaning control device selects said third cleaning mode first when said recording head is sealed by said capping device for a time longer than said predetermined time.

4. The ink-jet recording apparatus of claim 2, wherein, in said third cleaning mode, a first sucking operation, a rubbing operation to be effected after said first sucking operation and a second sucking operation after said rubbing operation are carried out regardless of said signal from said ink cartridge detecting device and said data of said sealing timer or opening timer.

5. The ink-jet recording apparatus of claim 1, further comprising an ink cartridge detecting device, wherein when said recording head is opened to atmosphere without being sealed by said capping device, said cleaning control device detects a presence or absence of said ink cartridge based on a signal from said ink cartridge detecting device, and when said ink cartridge is present, said cleaning control device selects said third cleaning mode.

* * * * *